United States Patent [19]

Allen

[11] 4,063,845

[45] Dec. 20, 1977

[54] TURBOMACHINE STATOR INTERSTAGE SEAL

[75] Inventor: Robert L. Allen, Greenwood, Ind.

[73] Assignee: General Motors Corporation, Detroit, Mich.

[21] Appl. No.: 732,285

[22] Filed: Oct. 13, 1976

Related U.S. Application Data

[63] Continuation-in-part of Ser. No. 583,548, June 4, 1975, abandoned.

[51] Int. Cl.[2] ..... F01D 25/26; F01D 9/00; F04D 29/40; F16J 15/48

[52] U.S. Cl. ..... 415/134; 415/217; 415/219 R; 277/204; 277/236

[58] Field of Search ..... 415/134–139, 415/171, 172 A, 173 R, 216–218, 219 R, 196; 277/204, 236

[56] References Cited

U.S. PATENT DOCUMENTS

| | | | |
|---|---|---|---|
| 843,740 | 2/1907 | Fenn | 277/204 |
| 1,543,963 | 6/1925 | Walton | 277/204 |
| 2,819,919 | 1/1958 | Pearce et al. | 277/204 |
| 2,991,045 | 7/1961 | Tassoni | 415/135 |
| 3,004,700 | 10/1961 | Warren | 415/216 |
| 3,132,870 | 5/1964 | Pschera | 277/204 |
| 3,728,041 | 4/1973 | Bertelson | 415/218 |
| 3,754,766 | 8/1973 | Asplund | 277/236 |
| 3,869,222 | 3/1975 | Rahnke et al. | 415/134 |

FOREIGN PATENT DOCUMENTS

| | | | |
|---|---|---|---|
| 244,726 | 2/1927 | United Kingdom | 415/136 |
| 180,822 | 6/1922 | United Kingdom | 277/204 |

*Primary Examiner*—John J. Vrablik
*Attorney, Agent, or Firm*—J. C. Evans

[57] ABSTRACT

Successive outer stator shroud rings of a gas turbine confront each other at the downstream edge of one and the upstream edge of the other, with a gap between them. To seal against leakage through this gap, edges of the shrouds have grooves aligned to define an annular cavity of generally rectangular cross section in the shrouds. A thin flexible coiled metal strip of about 720° extent is disposed in the cavity, with the strip overlapping itself to form a double layer. Layers of the strip are slidable relative to each other to allow the strip to expand and contract with the shrouds and abut outer or inner walls of the cavity to provide the seal.

3 Claims, 8 Drawing Figures

TURBOMACHINE STATOR INTERSTAGE SEAL

This is a continuation-in-part of Ser. No. 583,548 filed June 4, 1975 now abandoned.

My invention is directed to improved stator structures for turbomachines, and particularly to a new and improved seal to minimize leakage through a gap between successive shrouds of a turbine stator. In axial-flow turbines such as are used in gas turbine engines, for example, the outer boundary of an annular motive fluid path through the turbine is provided by stationary shrouds or stator shrouds. Such a shroud may be integral with or connected to the stator vanes which extend from the outer shroud to an inner shroud and direct the motive fluid into a turbine rotor stage. Or, a shroud may lie immediately outward of a rotor stage of the turbine so that the motive fluid is constrained to flow through the blades of the rotor stage.

For various structural reasons, the turbine stator shrouds are ordinarily constituted by successive sections from inlet to outlet of the turbine. Ordinarily some clearance must be provided between successive shrouds to allow for expansion, or for other reasons. There may be a pressure difference between the motive fluid inside the shroud and the air or other gas external to the shroud. The air external to the shroud may be air tapped from the compressor of the engine and ordinarily is at a higher pressure than the motive fluid. In any event, it is usually undesirable to have uncontrolled leakage through a gap between successive outer shrouds of a turbine.

Various arrangements for sealing such gaps have been proposed, but so far as I am aware, none similar to the one which is the primary subject matter of this application. According to my invention, a very simple sealing arrangement is provided by a flexible coil of thin sheet metal strip lying in opposed grooves in confronting faces of the shroud ring. The metal strip preferably is of about 720° extent so that a two layer coil of the strip is provided. Under the action of pressure differences and vibration in the engine, this coil can adjust itself inwardly or outwardly to lodge against the outer or inner walls of the grooves in the shroud ring, depending upon the direction of the pressure gradient.

The principal object of my invention is to provide a simple, durable, and inexpensive seal between successive shroud rings of a turbine stator.

The nature of my invention and its advantages will be clear to those skilled in the art from the succeeding detailed description of the preferred embodiment of the invention and the accompanying drawings thereof.

Figure 1:
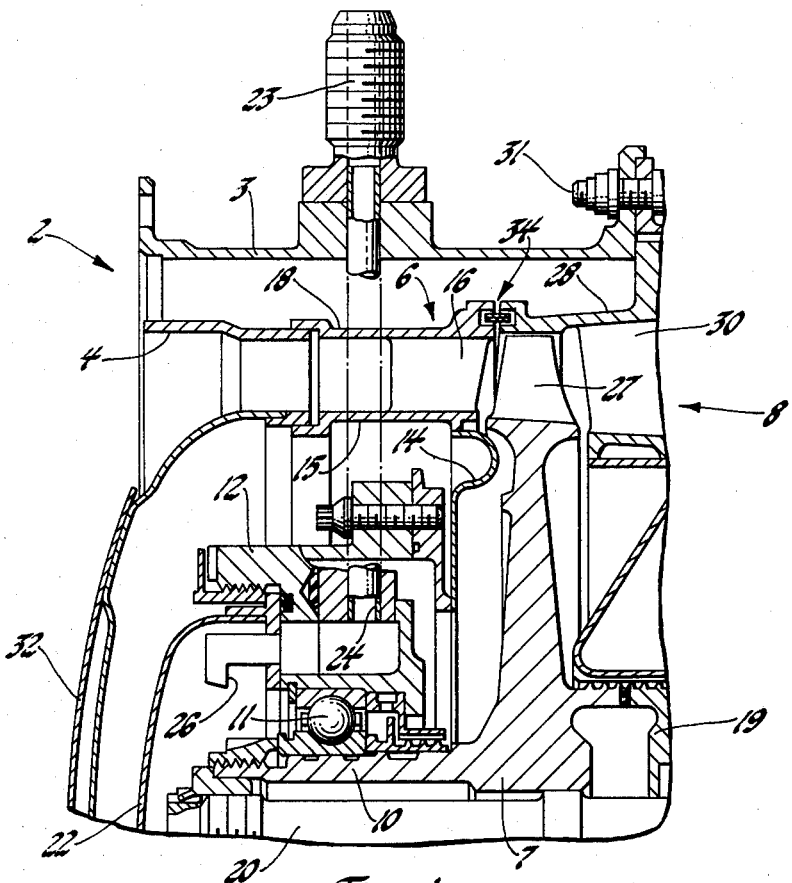
Figure 2:
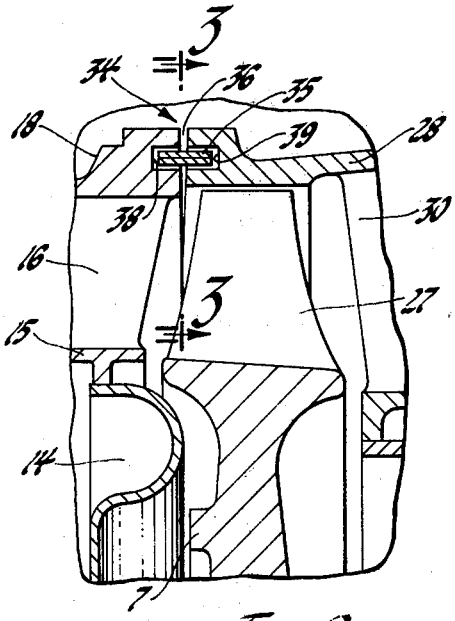
Figure 3:
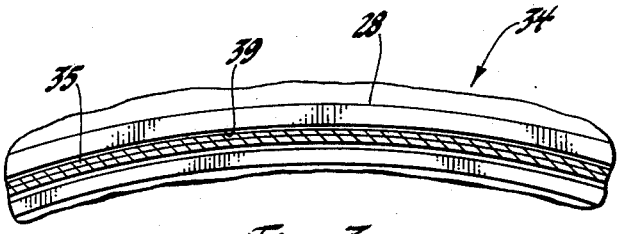
Figure 4:
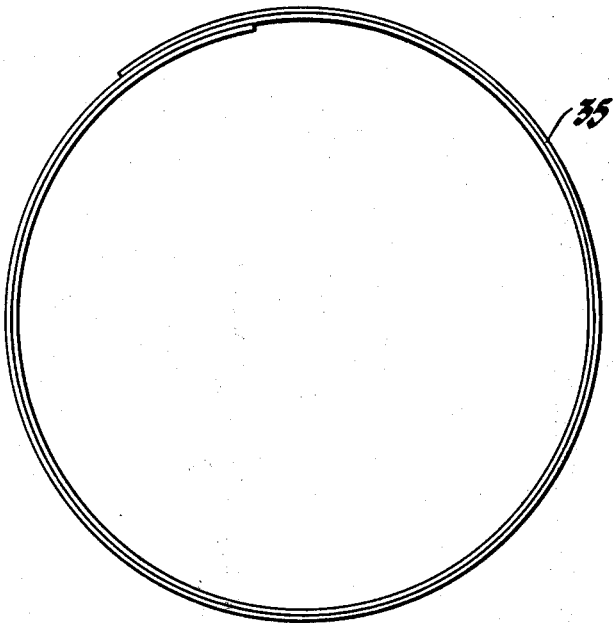
Figure 5:
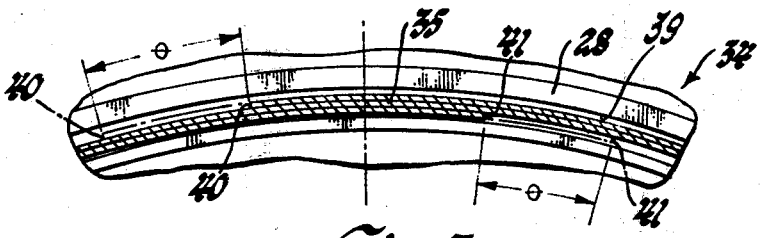
Figure 6:
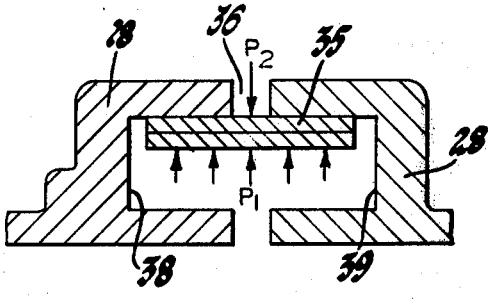
Figure 7:
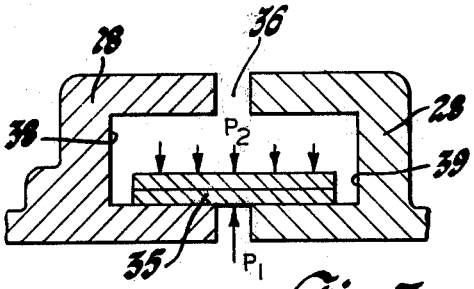
Figure 8:
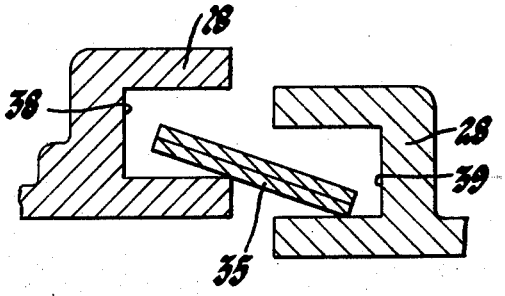

FIG. 1 is a partial view of a gas turbine taken on a plane containing the axis of rotation of the turbine, FIG. 2 is an enlargement of a portion of FIG. 1, FIG. 3 is a fragmentary cross-sectional view taken on the plane indicated by the line 3—3 in FIG. 2, FIG. 4 is an expanded end elevational view of a metal coil strip in the present invention, FIG. 5 is a fragmentary sectional view to illustrate movement of end segments of the coil in FIG. 4 to accommodate changes in coil diameter, FIG. 6 is an enlarged fragmentary sectional view of a first operating position of the coil strip and shroud components, FIG. 7 is a view like FIG. 6 showing a second operating position, and FIG. 8 is a view like FIG. 6 showing yet another operating position.

Referring first to FIG. 1, the seal structure of the invention is shown as incorporated in a gas turbine aircraft engine of known type having the United States military designation T63. The figure shows the first stage and part of the second stage of the high pressure turbine 2 of such an engine. The turbine 2 comprises an outer case ring 3, a turbine inlet annulus 4, a first stage turbine nozzle 6, a first stage turbine wheel 7, and a second stage turbine nozzle 8. The turbine wheel 7 is integral with a stub shaft 10 rotatably mounted by a ball bearing 11 in a bearing mount 12. The bearing mount is supported from the outer case ring 3 by struts (not illustrated). The nozzle 6 is supported from the bearing mount 12 by a flexible diaphragm 14 (see also FIG. 2) bolted to the bearing mount. The diaphragm is welded to the inner shroud 15 of the turbine nozzle 6, which is connected integrally by nozzle vanes 16 to an outer shroud ring 18. In this engine, the shroud 18 is a continuous integral 360° ring. The invention is applicable also to segmented shrouds, however.

The turbine wheel 7 is coupled to a second stage wheel 19, shown fragmentarily, by a tie bolt 20. Bearing 11 is disposed in a housing defined in part by a cover 22 which provides an oil sump for the bearing. Oil is supplied to the bearing from a connection 23 through an oil line 24 and a jet 26.

The first stage turbine wheel 7 bears a ring of blades 27 which are driven by the gas discharged from the nozzle 6. These vanes rotate closely within a second stage shroud 28 which is integral with vanes 30 of the second stage turbine nozzle. Shroud 28 is fixed through an expansion joint to the outer case ring 3 by bolts 31.

The engine combustion apparatus has an annular wall the outlet end of which is piloted within the turbine inlet annulus 4. This outlet is defined in part by a shield 32 disposed ahead of the turbine.

The foregoing constitutes a sufficient description of a presently preferred environment for my invention.

Referring now to FIGS. 2, 3 and 4 for a description of the seal arrangement 34, the seal is defined by a 720° coil 35 of thin strip metal, preferably in this case of 0.025 mm. thickness, which bridges the gap 36 between the shrouds 18 and 28. The seal strip is disposed in a groove 38 in the downstream edge of shroud 18 and a confronting groove 39 in the upstream edge of shroud 28. These grooves preferably are formed by machining. The strip has some degree of clearance axially and also radially so that it is free to expand and contract and expand differentially to the shrouds as temperature changes. Preferably, with a strip 0.025 mm. thick the radial dimension of the grooves 38 and 39 is 0.075 mm., leaving 0.025 mm. clearance in the radial direction. There is nothing critical about the axial clearance.

The coil 35 is preferably made of any high temperature resisting metal sheet or strip. Examples of suitable materials include AMS 5759 (a cobalt base high temperature material) and AMS 5545 (a nickel base high temperature material). Because of its small thickness, it is quite flexible and has an inherent bias that causes it to accommodate itself to lie against the inner or outer wall of the grooves 38 and 39. The coil 35 does not take a permanent set and it eliminates the need for a separate spring element to seat the seal coil. Assuming that the direction of pressure $P_2$ is from outside to inside, $P_2$ being greater than $P_1$, the pressure differential exerted through gap 36 will seat the ring against the inner wall of the grooves as shown in FIG. 7. The strip can slip circumferentially in response to gas pressure or physical force exerted by the supporting shrouds. The ability to slip is aided by the slight vibration due to rotation of the turbine. The circumferential slip action is shown in FIG. 5 wherein ends 40, 41 on the coil 35 are shown shifted by an angle $\theta$, illustrating movement produced under increased pressure $P_2$. Conversely, when pressure $P_1$ exceeds $P_2$ the coil 35 expands circumferentially by slip between segments of the coil 35 and will seat against the outer wall of the grooves as shown in FIG. 6.

The twice wound coil 35 and open face configuration of grooves 38, 39 has general application in turbine stator structures having radial pressure differentials to produce the effects shown in FIGS. 6 and 7. Further, in some high temperature turbines, the shroud ring 18 will be maintained at a higher temperature than the downstream second stage shroud 28. Thus, shroud ring 18 will have a greater diameter than shroud 28 because of thermal difference. The coil 35 slides and cants to accommodate this difference as shown in FIG. 8.

The simple and adequate character of the seal arrangement should be clear to those skilled in the art from the foregoing description.

The detailed description of the preferred embodiment of the invention for the purpose of explaining the principles thereof is not to be considered as limiting or restricting the invention, since many modifications may be made by the exercise of skill in the art.

The embodiments of the invention in which an exclusive property or privilege is claimed are defined as follows:

1. A turbine stator comprising, in combination, an annular upstream shroud having a continuously circumferentially formed downstream edge; an annular downstream shroud coaxial with the upstream shroud having a continuously circumferentially formed upstream edge confronting the downstream edge of the upstream shroud; said downstream edge being axially spaced from said upstream edge throughout the full circumferential extent of both said downstream and upstream edges to form an open gap extending radially therebetween continuously circumferentially therebetween; the confronting edges of the shrouds defining opposed grooves in the confronting edges; and seal ring means operable to oppose gas flow through the gap between the shrouds, the seal ring means being a thin flexible coiled metallic strip extending substantially twice around the axis of the shrouds and axially across the gap and within the grooves to provide two layers, the layers being mutually slidable to accommodate relative radial expansion of the shrouds and strip for seating of a surface of the strip radially against the shrouds.

2. A turbine stator comprising, in combination, an annular upstream shroud having a continuously circumferentially formed downstream edge; an annular downstream shroud coaxial with the upstream shroud having a continuously circumferentially formed upstream edge confronting the downstream edge of the upstream shroud; said downstream edge being axially spaced from said upstream edge throughout the full circumferential extent of both said downstream and upstream edges to form an open gap extending radially therebetween continuously circumferentially therebetween; the confronting edges of the shrouds defining opposed grooves in the confronting edges; and seal ring means operable to oppose gas flow through the gap between the shrouds, the seal ring means being a thin flexible coiled metallic strip extending substantially twice around the axis of the shrouds and axially across the gap and within the grooves to provide two layers, the layers being mutually slidable in response to pressure difference across the gap to accommodate relative radial expansion of the shrouds and strip for seating of a surface of the strip radially against the shrouds.

3. A turbine stator comprising, in combination, an annular upstream shroud having a continuously circumferentially formed downstream edge; an annular downstream shroud coaxial with the upstream shroud having an upstream edge confronting the downstream edge of the upstream shroud; the confronting edges of the shrouds defining opposed grooves in the confronting edges; and seal ring means operable to oppose gas flow through a gap between the shrouds, the seal ring means being a thin flexible coiled metallic strip extending substantially twice around the axis of the shrouds across the gap and within the grooves to provide two layers, the layers being mutually slidable to accommodate relative expansion of the shrouds and strip for seating of a surface of the strip radially against the shrouds, the strip having a thickness of the order of 1/40 millimeter.

* * * * *